US007329823B2

(12) United States Patent
Sadamori et al.

(10) Patent No.: US 7,329,823 B2
(45) Date of Patent: Feb. 12, 2008

(54) MOVABLE CONTACT ELEMENT AND PANEL SWITCH FORMED USING THE SAME

(75) Inventors: Akira Sadamori, Okayama (JP); Hiromichi Koyama, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/387,353

(22) Filed: Mar. 23, 2006

(65) Prior Publication Data

US 2006/0225996 A1 Oct. 12, 2006

(30) Foreign Application Priority Data

Apr. 12, 2005 (JP) ..... 2005-114145

(51) Int. Cl.
*H01H 13/70* (2006.01)

(52) U.S. Cl. ..... 200/516; 200/406

(58) Field of Classification Search ..... 200/512–517, 200/406, 5 A

See application file for complete search history.

(56) References Cited

U.S. PATENT DOCUMENTS

| | | | | |
|---|---|---|---|---|
| 5,401,922 | A * | 3/1995 | Asta | 200/5 A |
| 5,924,555 | A * | 7/1999 | Sadamori et al. | 200/512 |
| 6,259,046 | B1 * | 7/2001 | Iwama et al. | 200/5 A |
| 6,373,008 | B1 * | 4/2002 | Saito et al. | 200/310 |
| 6,548,778 | B2 * | 4/2003 | Takahashi | 200/516 |
| 6,906,274 | B2 * | 6/2005 | Ito et al. | 200/512 |
| 6,917,007 | B2 * | 7/2005 | Hirai et al. | 200/516 |
| 7,186,939 | B2 * | 3/2007 | Sera et al. | 200/516 |
| 2004/0234072 | A1 * | 11/2004 | Hirai et al. | 379/422 |
| 2006/0125174 | A1 * | 6/2006 | Sera et al. | 271/127 |

FOREIGN PATENT DOCUMENTS

| | | | |
|---|---|---|---|
| JP | 2002-203454 | 7/2002 | |
| WO | WO 01/80263 A1 | 10/2001 | |
| WO | WO02101776 A1 * | 12/2002 | 200/516 |

* cited by examiner

*Primary Examiner*—Elvin Enad
*Assistant Examiner*—M. Fishman
(74) *Attorney, Agent, or Firm*—RatnerPrestia

(57) ABSTRACT

A movable contact element includes a base sheet provided on its bottom surface with adhesive portions which are dotted around; an adhesive portion with a predetermined width which surrounds the entire edges of the base sheet; adhesive portions with a predetermined width which surround rectangular holes formed in the base sheet; and adhesive portions with a predetermined width which surround the circumferences of the circular movable contact points.

4 Claims, 9 Drawing Sheets

MOVABLE CONTACT ELEMENT AND PANEL SWITCH FORMED USING THE SAME

BACKGROUND OF THE INVENTION

1. Field of the Invention

The present invention relates to a movable contact element used for the operation panel of electronic devices such as mobile phones, and a panel switch formed using the movable contact element.

2. Background Art

In recent years, electronic devices such as mobile phones are being reduced in size and thickness. More and more such devices are having an operation panel with panel switches which is formed by pasting an insulating sheet with movable contact points onto the wiring board of the devices. Such an insulating sheet with movable contact points is called a movable contact element.

FIGS. 6 to 9 show a conventional movable contact element and a panel switch formed using the element.

FIG. 6 is a cross sectional view showing a main part of the conventional movable contact element, FIG. 7 is a bottom view showing a conventional base sheet; FIG. 8 is a cross sectional view showing a main part of a panel switch formed using the movable contact element, and FIG. 9 is an exploded perspective view showing the conventional panel switch.

As shown in FIGS. 6 and 7, movable contact element 6 includes base sheet 1 made of a flexible insulating resin. Base sheet 1 is approximately rectangular-shaped and is provided on its bottom surface with adhesive 2. Base sheet 1 is further provided with rectangular holes 1A in predetermined positions. Movable contact element 6 further includes a plurality of movable contact points 5 made of an elastic metal thin plate. Each movable contact point 5 has a convex dome shape, and the outer surface of the dome is bonded to the bottom surface of base sheet 1 by adhesive 2 applied on the bottom surface. Movable contact points 5 are arranged in predetermined positions in this manner so as to form movable contact element 6.

As shown in FIG. 7, adhesive 2 applied by screen printing or the like on the bottom surface of base sheet 1 consists of adhesive portions 3 dotted around. Through adhesive portions 3, non-adhesive portion 4 is spread like a net and reaches the edges of base sheet 1 and rectangular holes 1A in base sheet 1.

FIGS. 8 and 9 show the conventional panel switch formed using movable contact element 6.

An electronic device (unillustrated) includes wiring board 7, which is provided on its top surface with a plurality of fixed contact points 8. Each fixed contact point 8 consists of a pair of outer fixed contact point 8A and central fixed contact point 8B. Fixed contact points 8 are arranged corresponding to movable contact points 5 of movable contact element 6. The electronic device further includes LEDs 9 soldered in predetermined positions on wiring board 7 in such a manner as to correspond to rectangular holes 1A of base sheet 1.

Movable contact element 6 is bonded on wiring board 7 by adhesive 2 applied on the bottom surface of base sheet 1 as follows. Each movable contact point 5 is positioned so that its circumferential bottom edge is placed on the corresponding one of outer fixed contact points 8A, and that the top of its dome faces the corresponding one of central fixed contact point 8B with a spacing therebetween. Thus the panel switch includes a plurality of switches located corresponding to movable contact points 5. With movable contact element 6 bonded on wiring board 7, LEDs 9 are exposed from rectangular holes 1A of base sheet 1.

Adhesive 2 on the bottom surface of base sheet 1 is applied in the form of dots because of the following reasons. If adhesive is applied all over the bottom surface, the adhesion is to strong to smoothly position movable contact element 6 on wiring board 7 of the electronic device. Furthermore, adhesive 2 in the form of dots can be printed more easily onto base sheet 1, thereby securing the entire bottom surface of base sheet 1 to be bonded onto wiring board 7.

The operation of the panel switch will be described as follows. First suppose that the user presses somewhere on base sheet 1 that corresponds to the top of the dome of one of movable contact points 5. The dome of movable contact point 5 is pressed via base sheet 1. When the pressing force of the user exceeds a predetermined level, the dome is deformed elastically to be turned upside down with a sense of moderation. Then the inner surface of the dome comes into contact with the opposed central fixed contact point 8B. As a result, the switch goes into the ON state where outer fixed contact point 8A and central fixed contact point 8B are electrically connected with each other via movable contact point 5.

When the user release the pressing force, the inner surface of the dome leaves central fixed contact point 8B so as to restore movable contact point 5 to the original convex dome shape with a sense of moderation. As a result, the switch returns to the OFF state where outer fixed contact point 8A and central fixed contact point 8B are electrically isolated from each other.

LEDs 9 are turned on and off according to a signal generated when a specific switch is operated.

The bottom surface of base sheet 1 is generally covered with a separator before movable contact element 6 is bonded on wiring board 7. Separators are used to protect movable contact points 5 from dust and foreign matters during transportation and storage. The separator is made of a flexible insulating film having a release-processed top surface. A detailed description of the separator will be omitted here.

Prior art documents related to the invention of the present application include patent document 1 (Japanese Patent Unexamined Publication No. 2002-203454) and patent document 2 (International Publication pamphlet WO 01/080263).

In the aforementioned conventional movable contact element and panel switch formed using the element, adhesive 2 on the bottom surface of base sheet 1 consists of adhesive portions 3 dotted around, and non-adhesive portion 4 is spread through adhesive portions 3 to let air in and out from the edges of base sheet 1. Therefore, repeatedly applying and releasing a pressing force to/from movable contact points 5 so as to repeatedly turn on and off the switches moves around the air contained in the domes of movable contact points 5. This allows air to move between non-adhesive portion 4 on the bottom surface of base sheet 1 and outside base sheet 1.

The air movement may cause fine foreign matters contained in the air to get into the contact area between movable contact points 5 and fixed contact points 8 through non-adhesive portion 4, thereby damaging the contact stability of the switches.

SUMMARY OF THE INVENTION

The movable contact element of the present invention includes a movable contact point made of an elastic metal thin plate and having a convex dome shape. The element further includes a base sheet made of a flexible insulating resin and provided on the bottom surface thereof with adhesive portions dotted around. The adhesive portions fix the outer surface of the movable contact point on the bottom surface of the base sheet. The base sheet is further provided on the bottom surface thereof with an adhesive portion with a predetermined width, which closely surrounds the circumference of the movable contact point. Providing the adhesive portion with the predetermined width protects the bottom of the movable contact point, which functions as the contact area, against the entry of insulating foreign matters remaining in the non-adhesive portion in the vicinity of the adhesive portions dotted around and fine insulating foreign matters entering from outside through the non-adhesive portion. This makes the movable contact element dust resistant, thus improving contact reliability.

The panel switch of the present invention includes the aforementioned movable contact element and a fixed contact point consisting of a pair of a central fixed contact point and an outer fixed contact point. The fixed contact point is disposed on a wiring board in such a manner as to correspond to the position of the movable contact point of the movable contact element. The movable contact point is positioned so that the circumferential bottom edge thereof is placed on the outer fixed contact point, and that the top of its dome faces the central fixed contact point with a predetermined spacing therebetween. With the base sheet bonded on the wiring board, the adhesive portion with the predetermined width, which closely surrounds the circumference of the movable contact point, seals the switch area formed by the movable contact point and the fixed contact point. This structure protects the contact area of the panel switch from dust and other foreign matters even during the switch operation, thereby making the panel switch high in contact reliability.

DETAILED DESCRIPTION OF THE INVENTION

Figure 1:
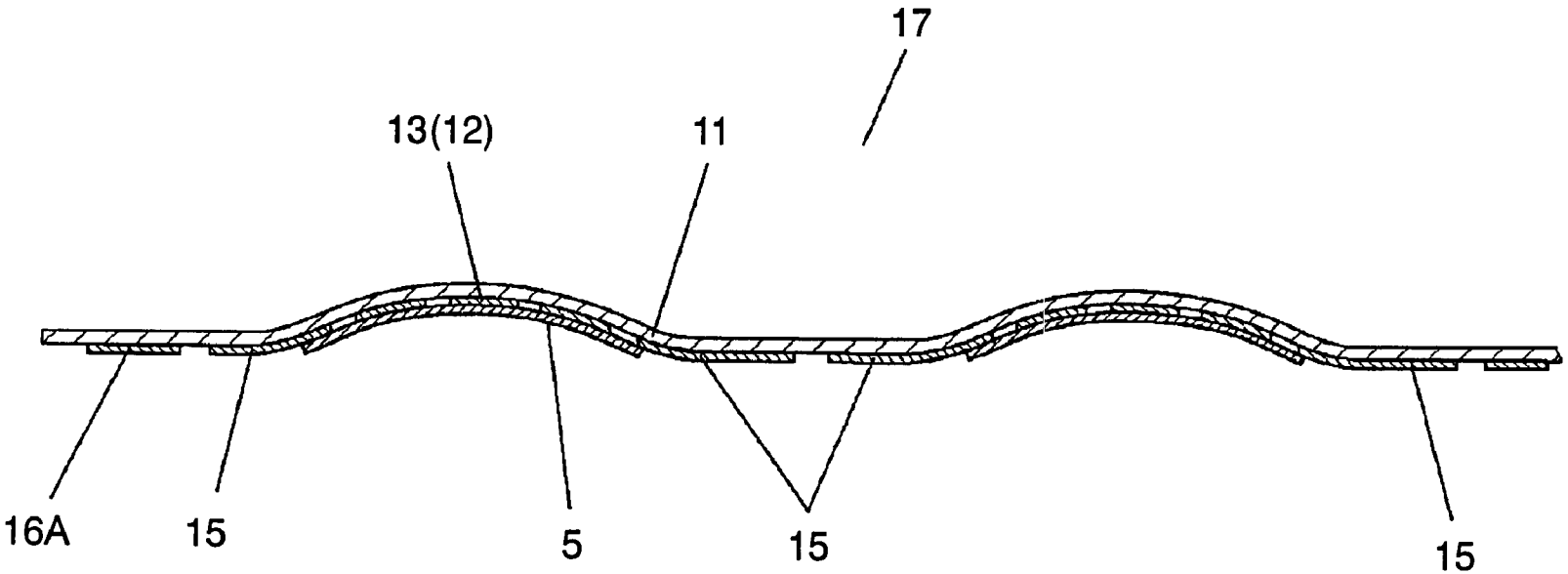
FIG. 1 is a cross sectional view showing a main part of a movable contact element of an embodiment of the present invention.

Embodiments of the present invention will be described as follows with reference to FIGS. 1 to 5.

Like components are labeled with like reference numerals with respect to Background Art, and the description of these components will be simplified.

Figure 2:
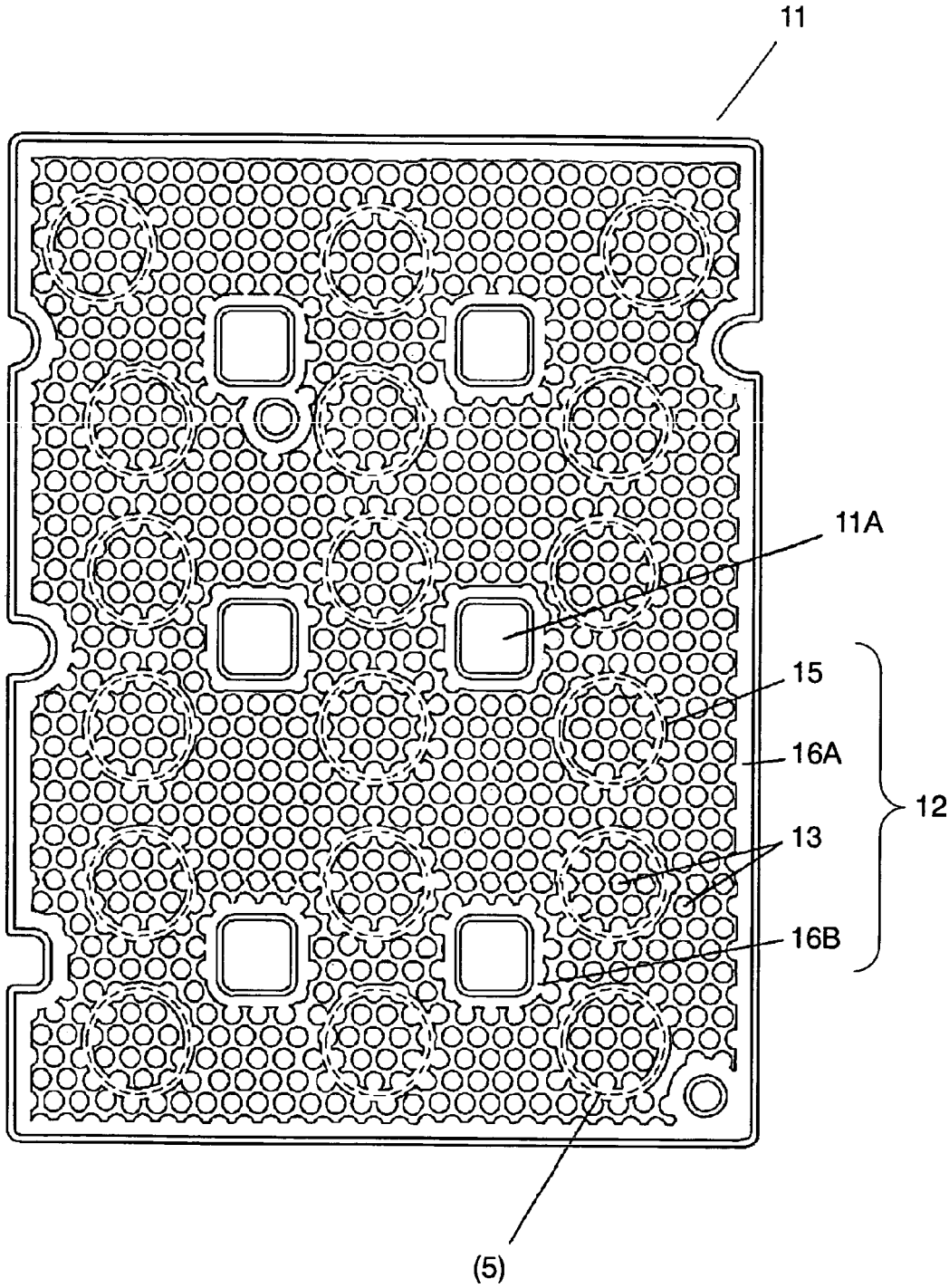
FIG. 2 is a bottom view showing a base sheet of the embodiment of the present invention.
Figure 3:
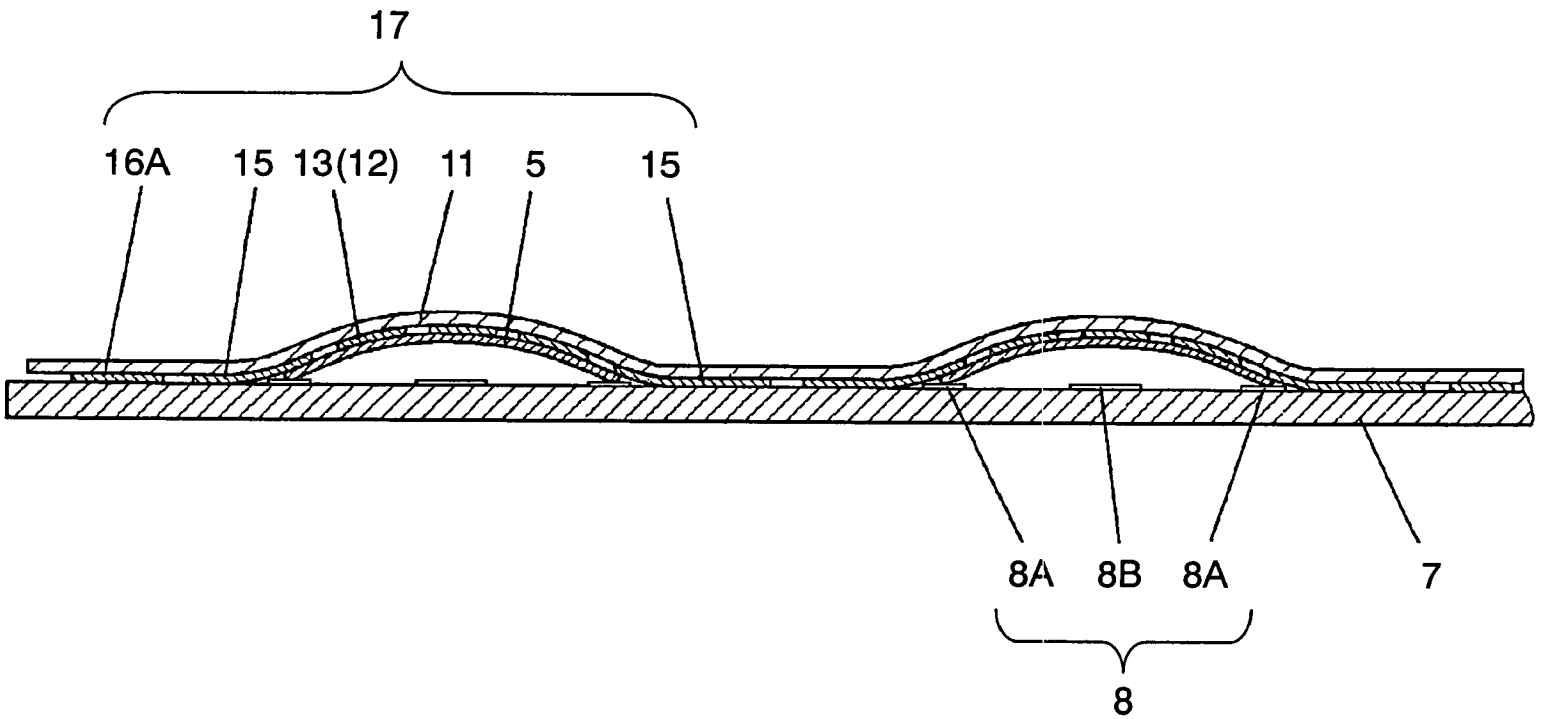
FIG. 3 is a cross sectional view showing a main part of a panel switch formed using the movable contact element of the embodiment of the present invention.

FIG. 1 is a cross sectional view showing a main part of a movable contact element of an embodiment of the present invention, FIG. 2 is a bottom view showing a base sheet of the embodiment of the present invention, and FIG. 3 is a cross sectional view showing a main part of a panel switch formed using the movable contact element of the embodiment of the present invention.

As shown in FIG. 1, movable contact element 17 includes base sheet 11, which is made of an insulating resin such as polyethylene terephthalate and has flexibility. Base sheet 11 is approximately rectangular-shaped and provided on its bottom surface with adhesive 12 applied in a predetermined pattern. Movable contact element 17 further includes movable contact points 5, which are made of an elastic thin metal plate such as stainless steel or phosphor bronze. Each movable contact point 5 is circular-shaped and has a convex dome shape.

Base sheet 11 of the present embodiment is further provided on its bottom surface with a plurality of rectangular holes 11A in predetermines positions as shown in FIG. 2. The pattern of adhesive 12 includes adhesive portions 13 dotted almost on the entire bottom surface; adhesive portion 16A with a predetermined width which surrounds the entire edges of base sheet 11; adhesive portions 16B with a predetermined width which surround rectangular holes 11A in base sheet 11; and adhesive portions 15 with a predetermined width which closely surround the circumferences of circular movable contact points 5 shown with broken lines in FIG. 2. These adhesive portions of adhesive 12 are printed by screen printing or the like.

Movable contact points 5 are placed in predetermined positions on the bottom surface of base sheet 11. The outer surface of the dome of each movable contact point 5 is fixedly bonded on the bottom surface of base sheet 11 by adhesive 12, more specifically, adhesive portions 13 arranged inside the corresponding one of adhesive portions 15. This is how movable contact element 17 of the present embodiment is formed.

The following is a description of a panel switch formed using movable contact element 17 with reference to FIG. 3. The panel switch includes wiring board 7, which is provided on its top surface with a plurality of fixed contact points 8. Each fixed contact point 8 consists of a pair of outer fixed contact point 8A and central fixed contact point 8B. Wiring board 7 is further provided on its top surface with LEDs 9 (unillustrated). LEDs 9 are soldered in the positions corresponding to rectangular holes 11A of movable contact element 17. Similar to the conventional movable contact element, fixed contact points 8 are arranged corresponding to movable contact points 5 of movable contact element 17.

In movable contact element 17, each movable contact point 5 is positioned so that its circumferential bottom edge is placed on the corresponding one of outer fixed contact points 8A, and that the top of its dome faces the corresponding one of central fixed contact points 8B with a spacing therebetween. In this manner, each movable contact point 5 is fixedly bonded on wiring board 7 by adhesive 12 applied on the bottom surface of base sheet 11. Thus the panel switch includes a plurality of switches located corresponding to movable contact points 5. LEDs 9 are exposed from rectangular holes 11A of base sheet 11 although it is not illustrated in FIG. 3.

The operation of each switch in the panel switch structured as above will be described as follows. Suppose that the user applies a pressing force on the top of the dome of one movable contact points 5 via base sheet 11. Movable contact point 5 is turned upside down with a sense of moderation to form a concave dome shape. Then the inner surface of the top of the dome comes into contact with the opposed central fixed contact point 8B. As a result, the switch goes into the ON state where outer fixed contact point 8A and central fixed contact point 8B are electrically conductive with each other via movable contact point 5.

When the user release the pressing force, the inner surface of top of the dome leaves central fixed contact point 8B. At the same time, movable contact point 5, which has been elastically deformed into a concave dome shape, is restored to the original convex dome shape with a sense of moderation. As a result, the switch returns to the OFF state.

LEDs 9 are turned on and off according to a signal generated when a specific switch is operated.

In the present embodiment, each adhesive portion 15 formed on the bottom surface of base sheet 11 of movable contact element 17 is bonded on wiring board 7 so as to closely surround the circumference of each movable contact point 5. Therefore, even when a pressing force is repeatedly applied to and released from movable contact points 5 to repeatedly turn on and off the switches, adhesive portions 15 protect the space formed by the dome of each movable contact point 5 and wiring board 7 from outside air. As a result, the switch contact area is protected against the entry of insulating foreign matters remaining in the non-adhesive portion on the bottom surface of base sheet 11, or dust and foreign matters entering from outside through the non-adhesive portion. This improves the reliability of the switch contact.

In the present embodiment, as described earlier, adhesive portion 16A with the predetermined width surrounds the entire edges of base sheet 11 of movable contact element 17. In addition, adhesive portions 16B with the predetermined width surround rectangular holes 11A from which LEDs 9 are exposed. Base sheet 11 is bonded in this manner on wiring board 7, so that the switch contact area can be double-protected against the entry of dust and foreign matters from outside. Furthermore, the edges of base sheet 11 can have higher adhesives strength, thereby being prevented from being turned up.

Figure 4:
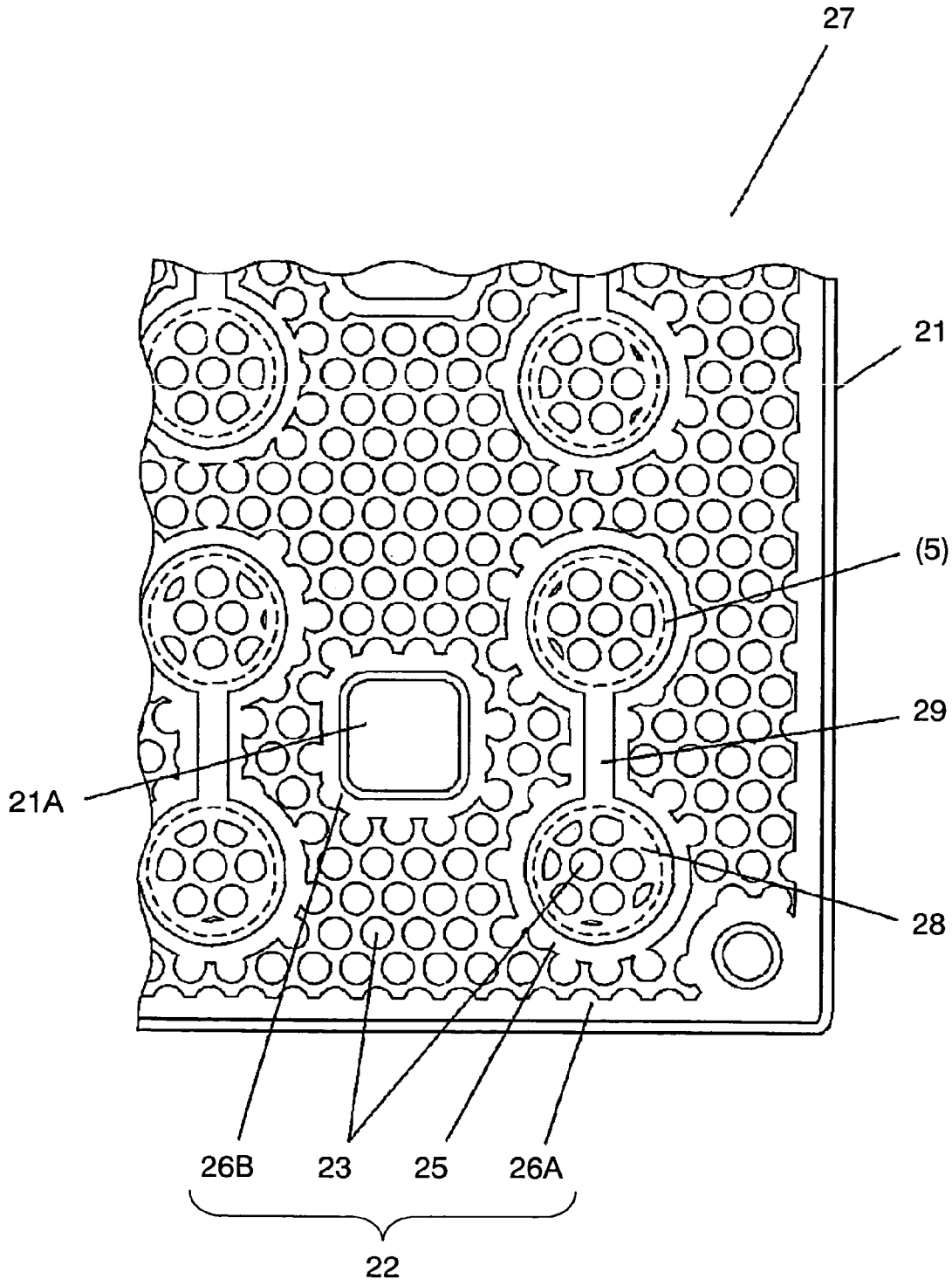
FIG. 4 is a bottom view showing a main part of a base sheet of a movable contact element of another embodiment of the present invention.

Besides the aforementioned pattern of adhesive 12 on the bottom surface of base sheet 11, another pattern can be used as shown in FIG. 4. An embodiment using the pattern will be described as follows with reference to FIG. 4.

As shown in FIG. 4, movable contact element 27 includes base sheet 21, which is approximately rectangular-shaped. Base sheet 21 is provided thereon with rectangular holes 21A in predetermined positions from which LEDs 9 are exposed. In the present embodiment, adhesive 22 is applied on the bottom surface of base sheet 21 in the same pattern as adhesive 12 in the embodiment shown in FIG. 2. More specifically, the pattern of adhesive 22 includes adhesive portions 23 dotted around; adhesive portion 26A with a predetermined width which surrounds the edges of base sheet 21; and adhesive portions 26B with a predetermined width which surround rectangular holes 21A.

In the present embodiment, base sheet 21 is further provided on its bottom surface with non-adhesive portions 28 with a predetermined width. Each non-adhesive portion 28 surrounds the circumference, including the peripheral region, of each movable contact point 5 shown with broken lines in FIG. 4. Base sheet 21 is further provided on its bottom surface with non-adhesive coupling portions 29 having a predetermined width. Each non-adhesive coupling portion 29 connects two adjacent movable contact points 5 surrounded by non-adhesive portions 28. Base sheet 21 is further provided on its bottom surface with adhesive portions 25 with a predetermined width. Each adhesive portion 25 surrounds the outline of two connected non-adhesive portions 28 and the outline of non-adhesive coupling portion 29 connecting them.

Figure 5:
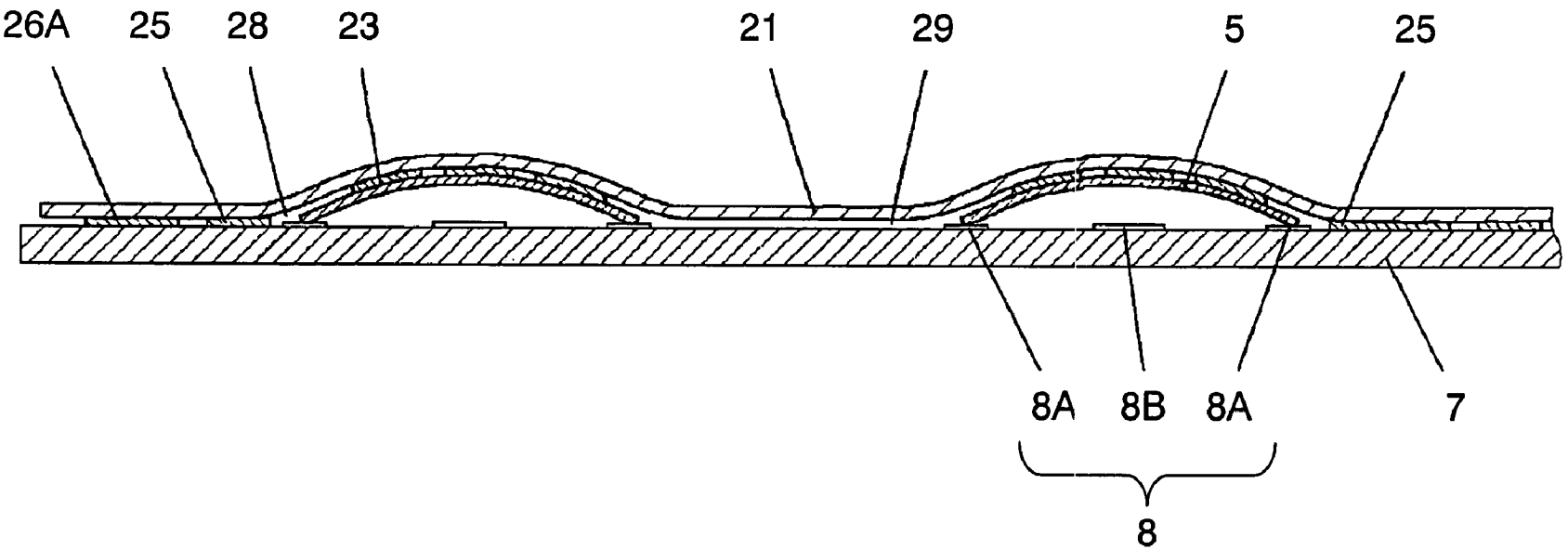
FIG. 5 is a cross sectional view showing a main part of a panel switch formed using the movable contact element of the other embodiment of the present invention.
Figure 6:
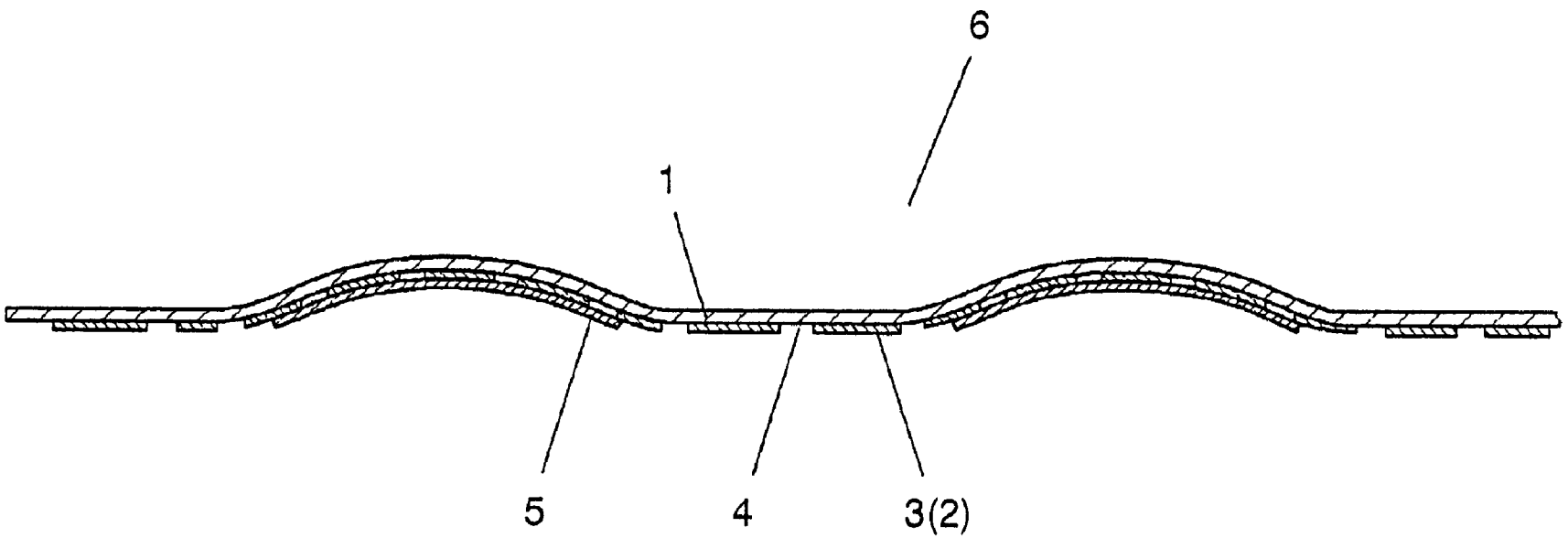
FIG. 6 PRIOR ART
FIG. 6 is a cross sectional view showing a main part of a conventional movable contact element.
Figure 7:
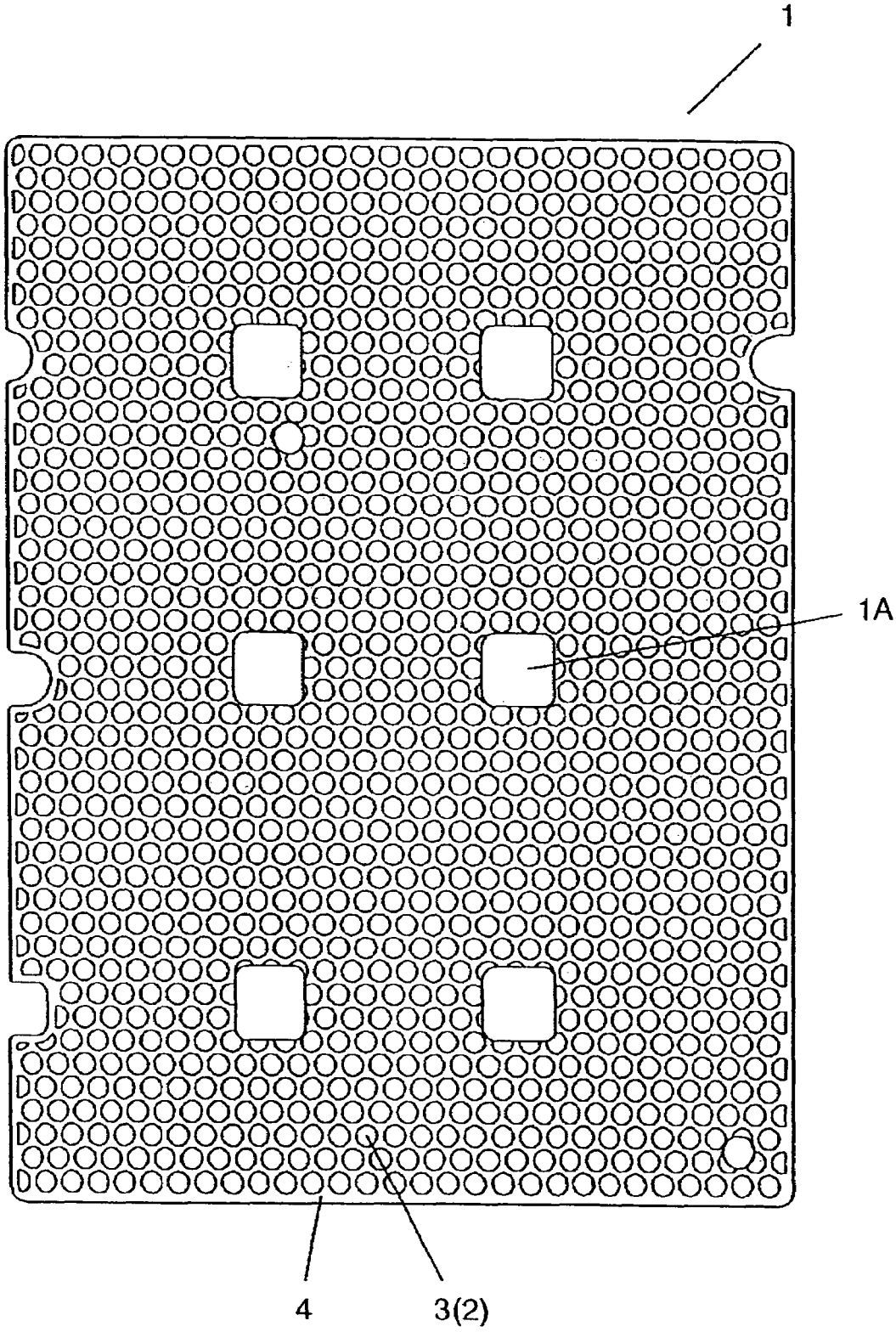
FIG. 7 PRIOR ART
FIG. 7 is a bottom view showing a conventional base sheet.
Figure 8:
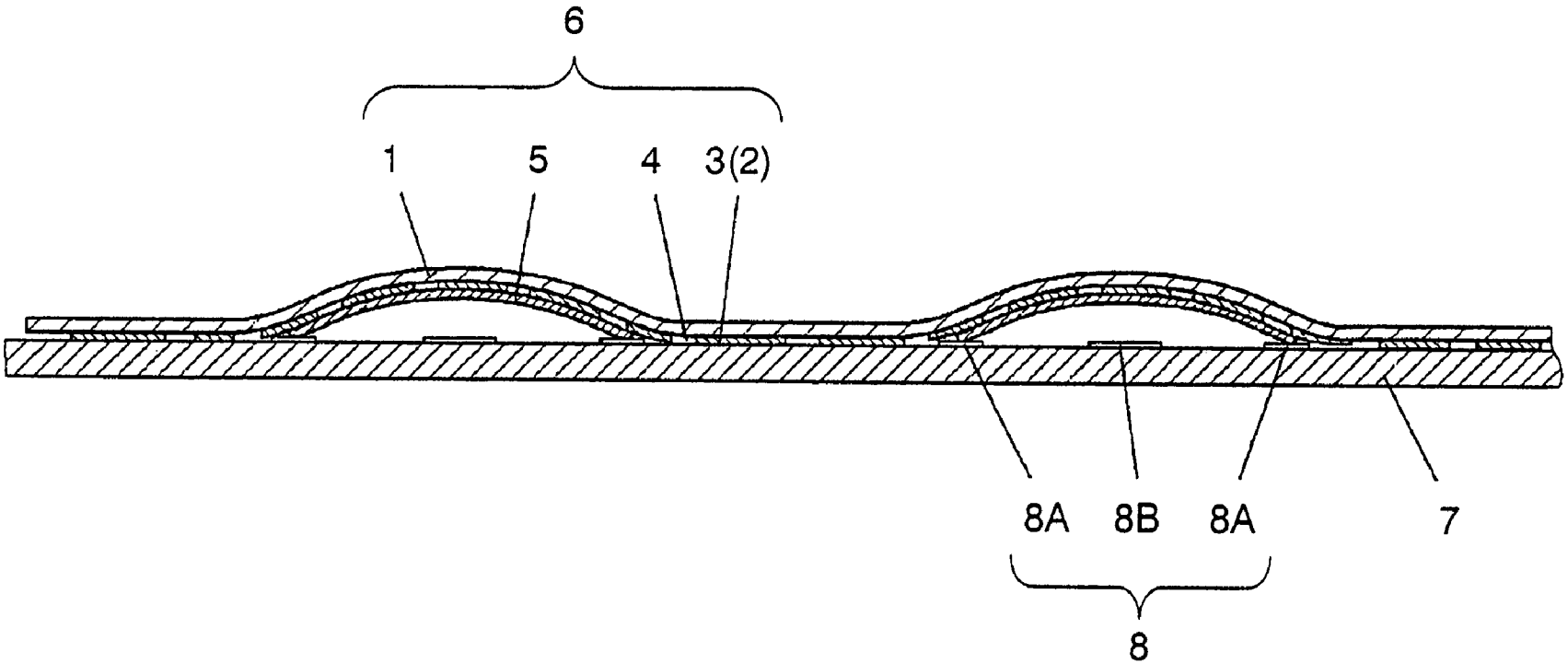
FIG. 8 PRIOR ART
FIG. 8 is a cross sectional view showing a main part of a panel switch formed using the conventional movable contact element.
Figure 9:
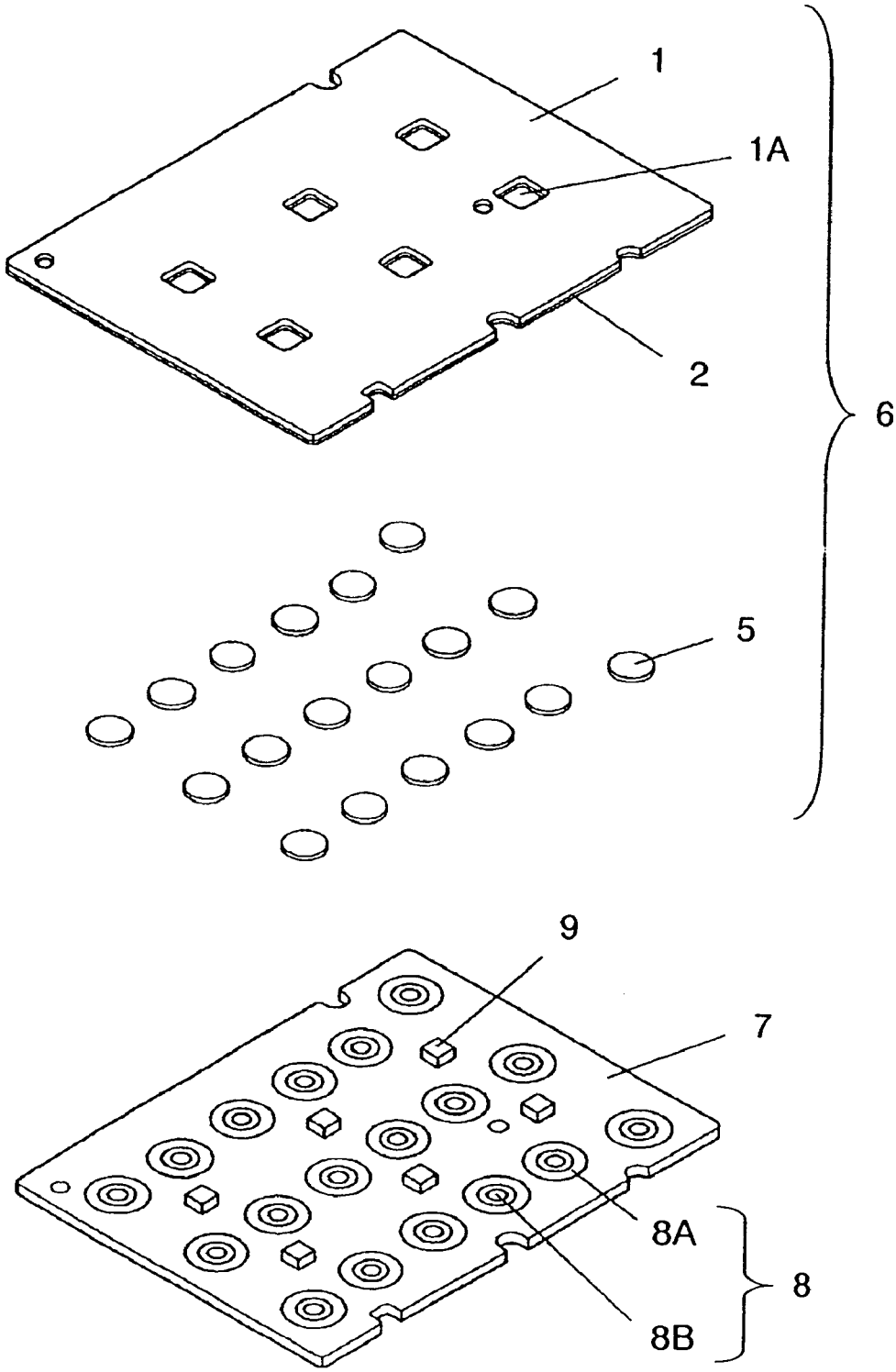
FIG. 9 PRIOR ART
FIG. 9 is an exploded perspective view showing the conventional panel switch.

Of the aforementioned adhesive portions of adhesive 22 applied on the bottom surface of base sheet 21, adhesive portions 23 inside each adhesive portion 25 fix the outer surface of the domed part of each movable contact point 5 onto the bottom surface of base sheet 21. This is how movable contact element 27 is formed. A panel switch, which is formed using movable contact element 27 in the same manner as the panel switch shown in FIG. 3, is shown in FIG. 5 as a cross sectional view. In the panel switch shown in FIG. 5, adhesive portion 26A and adhesive portions 26B (unillustrated) are provided on wiring board 7 to prevent the entry of dust and foreign matters from outside. In addition, adhesive portions 25 are provided on wiring board 7 to protect the switch contact area against the entry of insulating foreign matters remaining in the non-adhesive portions. The positional relationship between movable contact points 5 and fixed contact points 8 on wiring board 7 is not described in detail here because it is identical with that in the previous embodiment.

The operation of the panel switch will be described as follows.

First suppose that the user applies a pressing force on the top of the dome of one of movable contact points 5 via base sheet 21. Movable contact point 5 is turned upside down with a sense of moderation to form a concave dome shape. Then the inner surface of the top of the dome comes into contact with the opposed central fixed contact point 8B. As a result, the switch goes into the ON state where outer fixed contact point 8A and central fixed contact point 8B are electrically conductive with each other. When the user release the pressing force, the inner surface of top of the dome leaves central fixed contact point 8B. At the same time, movable contact point 5 is restored to the original convex dome shape with a sense of moderation. As a result, the switch returns to the OFF state.

As described above, adhesive portions 25 are provided on wiring board 7 so as to surround movable contact points 5 on the bottom surface of base sheet 21. When one of movable contact points 5 is pressed to operate the switch, the air in the dome of movable contact point 5 is compressed by the inner surface of the dome. In the present embodiment, the compressed air in movable contact point 5 moves to the other movable contact point 5 connected via non-adhesive coupling portion 29. When the user releases the pressing force, the air returns to the previous movable contact point 5.

This structure can reduce air compression so as to decrease the influence of air on the force to press the switches. As a result, the movable contact element and the panel switch formed using the element can protect the switch contact area against the entry of foreign matters so as to ensure dust resistance, and can also provide the user with excellent operation feeling.

In the embodiment, each non-adhesive coupling portion 29 connects two movable contact points 5. Instead, a larger number of non-adhesive portions 28 can be connected based on the arrangement of movable contact points 5 and LEDs 9 so as to improve the operation feeling.

What is claimed is:

1. A movable contact element comprising:

a base sheet comprising a plurality of movable contact points, each of said movable contact points being made of an elastic metal thin plate and having a convex dome shape, the base sheet being made of a flexible insulating resin and having a bottom surface, the bottom surface having a plurality of first adhesive portions, each first adhesive portion separated from each other by a non-adhesive area, the first adhesive portions fixing each of the movable contact points to the bottom surface of the base sheet, the bottom surface having a plurality of second adhesive portions, each of said second adhesive portions surrounding a respective one of the plurality of movable contact points.

2. The movable contact element of claim 1, wherein each of the second adhesive portions is provided so as to surround an outline of a section of the non-adhesive portion and an outline of a non-adhesive coupling portion having a predetermined width, the section of the non-adhesive portion surrounds a circumference of the movable contact point including a peripheral region of the movable contact point, and the non-adhesive coupling portion connects at least two movable contact points.

3. The movable contact element of claim 1, wherein the base sheet is further provided, along edges of the bottom surface thereof, with a third adhesive portion having a predetermined width.

4. A panel switch comprising:

the movable contact element of claim 1; and a plurality of sets of fixed contact points, each set of fixed contact points consisting of a pair of a central fixed contact points and an outer fixed contact point, the fixed contact point being disposed on a wiring board in such a manner as to correspond to a position of a corresponding one of the movable contact points of the movable contact element;

wherein each movable contact point is positioned so that a circumferential bottom edge thereof is placed on a corresponding one of the outer fixed contact points, and so that a top of each dome faces the corresponding central fixed contact point with a predetermined spacing therebetween.

* * * * *